United States Patent [19]

Hirata

[11] 4,391,366

[45] Jul. 5, 1983

[54] FOLDABLE CUP

[75] Inventor: Isao Hirata, Sagamihara, Japan

[73] Assignee: Tokai Metals Company Limited, Yokohama, Japan

[21] Appl. No.: 260,843

[22] Filed: May 5, 1981

[30] Foreign Application Priority Data

Feb. 9, 1981 [JP] Japan ..... 56-16847

[51] Int. Cl.[3] ..... B65D 5/46; B65D 5/54; B65D 5/56; B65D 85/72

[52] U.S. Cl. ..... 206/218; 206/629; 220/462; 229/1.5 B; 229/41 C; 229/41 D; 229/48 T; 229/52 B; 426/115; 426/122

[58] Field of Search ..... 229/41 C, 41 D, 1.5 B, 229/57, 55, 53, 52 B, 48 R, 48 SA, 48 T; 220/462, 463, 418; 206/629, 630, 632, 218; 426/411, 415, 122, 123, 115

[56] References Cited

U.S. PATENT DOCUMENTS

| | | | |
|---|---|---|---|
| 2,382,573 | 8/1945 | Moore | 229/48 T |
| 3,136,475 | 6/1964 | Geimer | 229/57 |
| 3,372,859 | 3/1968 | Bjorkengren et al. | 229/48 T |
| 3,373,917 | 3/1968 | Cox | 229/41 C X |
| 3,375,969 | 4/1968 | Davis, Jr. | 229/53 |
| 3,437,258 | 4/1969 | Kugler | 229/57 |
| 3,640,381 | 2/1972 | Kanada et al. | 229/55 X |
| 3,659,777 | 5/1972 | Kanada et al. | 229/55 |
| 3,684,156 | 8/1972 | Fettinger et al. | 206/629 X |
| 4,196,034 | 4/1980 | Kimurg | 229/55 X |
| 4,284,205 | 8/1981 | Hirata | 229/41 D X |

FOREIGN PATENT DOCUMENTS

| | | | |
|---|---|---|---|
| 738267 | 7/1966 | Canada | 229/57 |
| 55-50314 | 9/1978 | Japan . | |
| 231119 | 3/1925 | United Kingdom | 229/41 C |
| 1069268 | 5/1967 | United Kingdom | 229/57 |

*Primary Examiner*—Allan N. Shoap

*Attorney, Agent, or Firm*—Cushman, Darby & Cushman

[57] ABSTRACT

A foldable cup comprising a collapsed flat tubular outer shell made of a hard material and having open opposite ends and a collapsed flat pouch made of a flexible material and fixedly inserted within the outer shell. This flat foldable cup can be expanded, when the outer shell is opened, without developing crumpled portions in the bottom walls of the pouch and the outer shell.

7 Claims, 12 Drawing Figures

FOLDABLE CUP

BACKGROUND OF THE INVENTION (a) The present invention relates to a convenience cup, and more particularly it concerns a foldable cup which can be folded into a collapsed flat assembly when not in use, and which can be expanded from the collapsed state into a cubic configuration when in use to serve as a container for beverage and food.

(b) The inventor has already proposed, in Japanese Preliminary Patent Publication No. Sho 55-050314 a foldable cup which comprises a collapsed flat tubular outer shell made of a hard material having open opposite ends and a collapsed flat flexible pouch which is fixedly inserted within the outer shell, and which is arranged so that when the outer shell is opened, the pouch is also expanded accordingly therewith.

SUMMARY OF THE INVENTION

A primary object of the present invention is to provide the abovesaid foldable cup which is improved with respect to practical problems of the prior art.

Another object of the present invention is to provide a foldable cup of the type as described above, which, when the outer shell is expanded, the bottom wall of the pouch can be expanded with no crumpled portions developing therein, without requiring any assisting means for its expansion.

Still another object of the present invention is to provide a foldable cup of the type as described above, which insures the expansion of the pouch in synchronism and in good compliance with the outer shell and prevents a leak of liquid which is contained in the pouch.

Other objects of the present invention will become apparent from the following detailed description when taken in conjunction with the accompanying drawings.

DETAILED DESCRIPTION OF THE PREFERRED EMBODIMENTS

Figure 1:
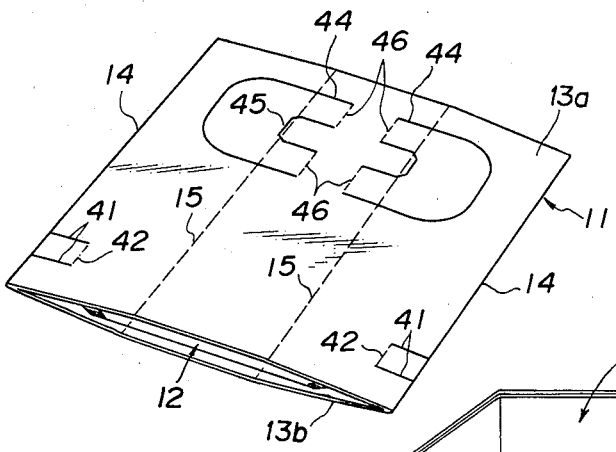
FIG. 1 is a diagrammatic perspective view of an embodiment of the foldable cup according to the present invention.
Figure 2:
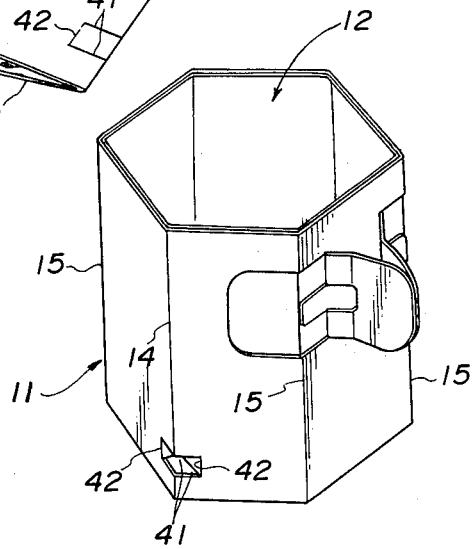
FIG. 2 is a diagrammatic perspective view of the above embodiment in its expanded state.

In FIG. 1, reference numeral 11 represents an outer shell, and 12 a pouch. The outer shell is made of a hard sheet material and has a flat tubular shape having open opposite ends. A pair of opposing walls 13*a* and 13*b* or flaps of the outer shell can be bent along the outermost lateral creases or edges which divide the sheet into these two flaps. These flaps 13*a* and 13*b* of the outer shell are each further bent along two intermediate folding lines and formed between said lateral edges. Two of such folding lines 15 are shown for wall 13A in FIG. 1. On the other hand, the pouch 12 is made with a flexible material, and is provided as a flat tubular member having one open end and closed other end. This pouch 12 is fixedly received in the outer shell. When the outer shell is bent along the lateral edges and the folding lines, the pouch 12 is caused to open along therewith. FIG. 2 shows the foldable cup in its fully expanded state.

Figure 3:
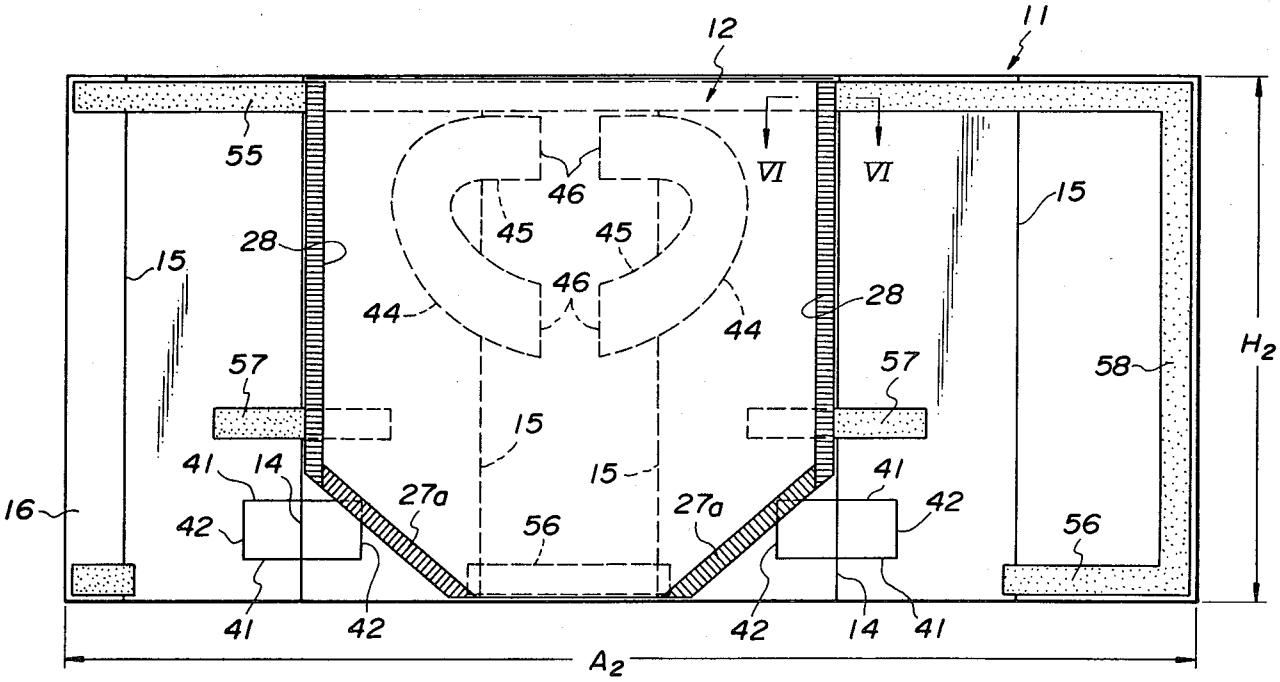
FIG. 3 is a diagrammatic front view of the outer shell in its developed state.
Figure 4:
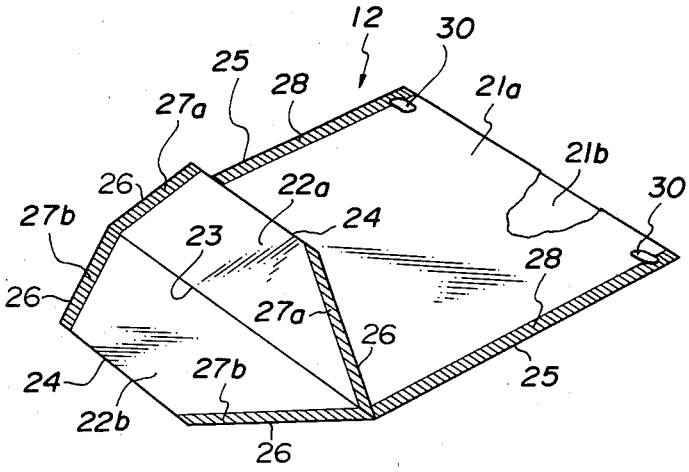
FIG. 4 is a diagrammatic perspective view of the pouch, showing the state that its bottom portion is opened from its folded state.
Figure 5:
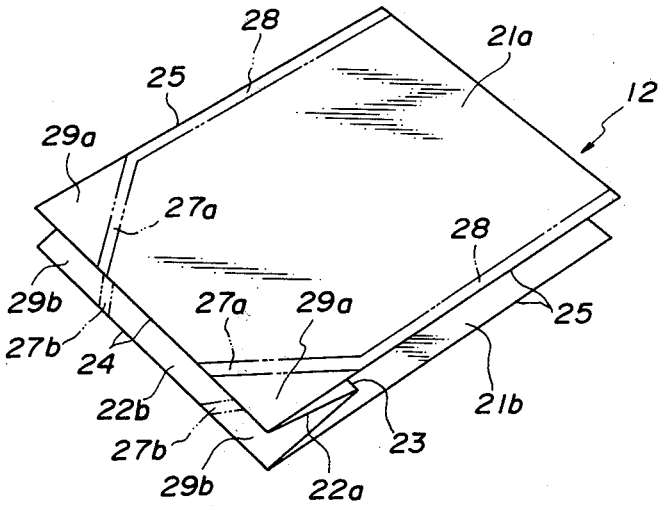
FIG. 5 is a diagrammatic explanatory illustration, showing the pouch structure.

As shown in an exploded fashion in FIG. 3, the outer shell 11 is prepared with a rectangular sheet of cardboard or synthetic resin, having six parallel folding lines 14 and 15 formed at equal intervals, and having, at one vertical edge portion, the formation of an extra marginal blank portion 16 which is to be superposed on the other vertical marginal edge portion and bonded with each other. As shown in FIG. 4, the pouch 12 has a pair of opposing walls 21*a* and 21*b*, and the lateral edges of these walls are continuous with each other. A pair of bottom walls 22*a* and 22*b* are located on the inner side of the walls 21*a* and 21*b*, and the upper end edges 23 of these respective bottom walls 22*a* and 22*b* are continuous with each other into a common upper end edge 23, while the respective lower end edges 24 of the paired bottom walls 22*a* and 22*b* are continuous with the respective bottom end edges of the opposing walls 21*a* and 21*b*. The respective lateral edges 25 and 25 of the opposing walls 21*a* and 21*b* are continuous with the respective lateral edges 26 and 26 of the respective bottom walls. Accordingly, when the opposing walls 21*a* and 21*b* are expanded outwardly, the bottom walls also can be expanded accordingly. In practice, the pouch 12 is prepared by folding a sheet into W-shape, and the opposing walls 21*a* and 21*b* are formed integrally with the bottom walls. The sheet, desirably, is comprised of an aluminum foil laminated, on the inner surface, with a film of a synthetic resin. Such laminated sheet is folded, with the synthetic resin film lying on the inside. The coupling of end edges of this sheet is performed by subjecting the required portions of the folded sheet to thermal welding by relying on heat-sealing technique. That is, as shown in FIG. 5, a rectangular sheet of aluminum foil laminated with a synthetic resin film is folded into W-shape, and the opposing body walls 21*a*, 21*b* and the bottom walls 22*a*, 22*b* are formed as an integral body. The body wall 21*a* and the bottom wall 22*a*, and the body wall 21*b* and the bottom wall 22*b* are connected together, respectively, by the corresponding seal portions 27*a* and 27*b* which extend obliquely downwardly from the lateral edges toward the bottom edges. On the other hand, the lateral marginal edge portions 25 are connected together by the seal portions 28. The non-connection portions between the bottom walls and the opposing body walls, i.e. the triangular portions indicated at 29a and 29b in FIG. 5 are cut off while leaving the seal portions 27a and 27b.

Figure 6:
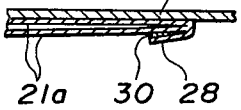
FIG. 6 is a diagrammatic sectional view, in an enlarged scale, taken along the line VI—VI in FIG. 3.

As shown in FIG. 3, the pouch 12 is placed on the developed sheet of outer shell 11 so as to extend up to the lateral edges 14 and 14 of the outer shell 11 including the inner folding lines 15 and 15, and also in such way that the outer vertical marginal edge lines of the inwardly folded seal portions 28 and 28 (see FIGS. 3 and 6) of the pouch are located in substantial agreement with the inside of the lateral edges 14 and 14, respectively, of the outer shell 11. The outer shell sheet is then folded inwardly along the lateral edges 14 and 14, and the extra marginal blank portion 16 is positioned on the inside of the opposite marginal edge portion, followed by bonding them together, whereby the cup is fabricated. The fixation of the pouch to the outer shell is accomplished by preliminarily applying a bonding agent to the required portions of the inner surface of the outer shell. It should be understood that the folding of the seal portions 28 of the pouch may be performed in an alternative fashion such that the pouch having unfolded seal portions 28 is placed on the developed outer shell in such way that the folding lines thereof are located to substantially agree with the lateral edges 14 and 14, and that then the outer shell is bent along said lateral folding lines 14 and 14.

It is, however, desirable to arrange so that, when the seal portions 28 and 28 of the pouch 12 are folded on the body wall of the pouch, these respective portions are bonded to the body wall of the pouch. By so doing, it becomes possible to prevent the undesirable leak of a liquid, which could be the contents in the pouch, to the outside thereof through otherwise non-bonded marginal portions of the pouch. Such bonding need be given, in practice, only to the vicinity of the upper end edges of the pouch. Such bonded portions of the pouch are shown at 30 in FIGS. 4 and 6.

When the outer shell 11 is folded along the outer and inner folding lines 14, 14 and 15, 15 which are formed thereon, the pouch 12 will be opened at its open end in accordance with the folding of the outer shell 11. It should be understood that, since the seal portions 28 and 28 which are provided on the opposite lateral edges of the pouch are superposedly folded against the body wall of the pouch, and the resulting lateral vertical folding lines of this pouch are substantially in agreement with the lateral edges 14 and 14 of the outer shell, the cup can be opened without causing a clearance or gap to be left between the inside wall surfaces of the outer shell and the outside wall surfaces of the pouch. At the same time, the bottom walls 22a and 22b of the pouch are expanded in flat fashion. Along therewith, portions of the pouch are bent upwardly along the line connecting the crossing point between the seal portion 27a and the bottom edge 24 and the crossing point between the seal portion 27b and the bottom edge 24, so that the pouch 12 can be opened without substantially developing wrinkles or crumples in the bottom walls of the pouch. It should be understood, however, that in the present invention, the above description does not mean that strictly no wrinkles or crumples will develop at all. The above description should be understood to mean that there develop no such ridges or crumples as will cause the powdery contents, i.e. instantly cooking powder food, to become pieces of masses or granules when the powdery contents are dissolved in a liquid in the pouch.

Figure 7:
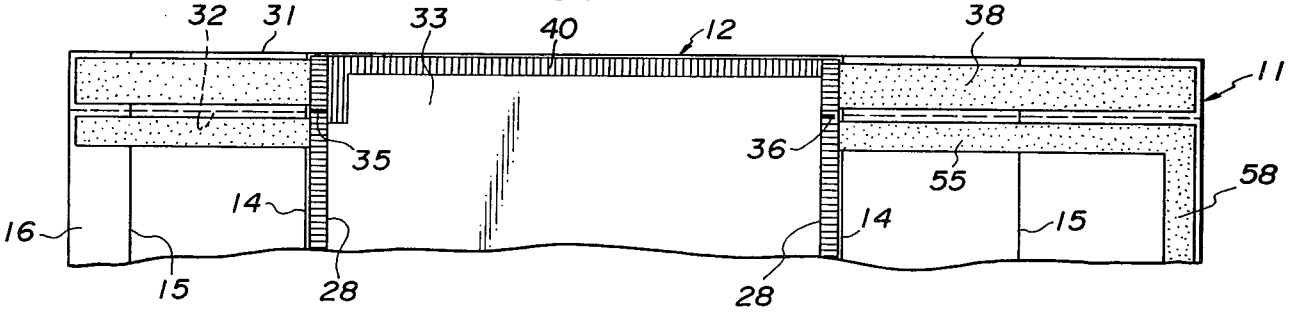
FIG. 7 is a diagrammatic front view of the upper portions of the outer shell and the pouch in their developed state, representing a modification of the foldable cup according to the present invention.

The convenience foldable cup according to the present invention can be arranged so that each of the outer shell and the pouch has an extension which extends beyond the upper end edge of the body wall thereof, and that the extension portion of the pouch is bonded, at its inner face, to each other when folded, and that a tear-off line is provided between the main body and the extension portion of the outer shell. Such cup can be made to serve as a tableware by enclosing into the pouch an instantly cookable food such as one having a powdery or granular or paste-like configuration and being intended to be mixed or dissolved or both in a liquid before the open ends of the pouch and the outer shell are sealed. Thus, this cup serves as a packing container also in addition to the use as described above. In FIG. 7, the tear-off portion is shown at 31 which extends beyond the upper end edge of the outer shell 11. This extension portion 31 is provided with a tear-off line 32 between the extension portion and the outer shell. On the other hand, the pouch 12 has an extension portion 33 which extends beyond the upper edge of the pouch up to a position corresponding to the upper end edge of the extension portion 31 of the outer shell. After an instantly cooking food such as powdery soup prepared by freeze-drying method is enclosed within the pouch, the resinous film portions of the extension of the pouch are sealed at their inner sides by heat-sealing technique. In the drawings, such seal portions are indicated at 40. In use, the extension portion of the outer shell is torn off along the tear-off line 32, whereby the pouch 11 is opened.

In order to facilitate the tear-off of the extension portion of the pouch, there may be provided cut-outs in the lateral marginal portions at sites corresponding to the tear-off line of the outer shell. In FIG. 7, such cut-outs are provided in both lateral marginal portions of the pouch. One 35 of the cut-outs extends beyond the width of the folded seal portion 28 of the pouch, and up to the body wall of this pouch. However, the seal portions 40 for bonding the uppermost edge portions of the body wall of the pouch extend up to one of the cut-outs of the pouch, so that the contents of the pouch are inhibited from leaking out of the pouch through the cut-outs. The other cut-out 36 is provided in said seal poriton so as to have a length shorter than the width of the seal portion 28.

These cut-outs will function that, when the extension portions of the outer shell are torn off along the tear-off line, starting at that side where the cut-out 35 is provided, the extension portions of the pouch per se can be removed easily along the tear-off line of the outer shell. Furthermore, such cut-outs serve to facilitate an easy opening of the pouch even in case the material of the pouch is such that the molecules of this material are oriented in a direction different from the direction in which the extension portions of the pouch walls are ripped off easily. The ripping-off of a film made of a synthetic resin can be accomplished with much less force along the direction in which the molecules are oriented in a direction perpendicular to the direction of drawing of the film during the production of the latter, as compared with the ripping-off direction along the direction of drawing. However, owing to the presence of such cut-outs, the opening of the pouch can be made easily even when the direction drawing of the material of the pouch is not in agreement with the direction of the cut-outs. It should be understood here that the cut-out 36 may be arranged in a manner similar to that of the cut-out 35, or the cut-out 36 may be omitted.

The outer shell is provided, at its both lateral edges, with two parallel cut-outs 41 and 41 which cross said lateral edges at right angle, and also with folding lines 42 and 42 to connect the opposite ends of these cut-outs, respectively. These cut-outs are disposed in the outer shell so as to be located lower than the crossing points of the lateral edge 25 of the body wall and the lateral edge 26 of the bottom wall of the pouch 12. Because of the portions of the outer shell sandwiched between the two cut-outs 41 and 41 are bent toward the inside of the outer shell as shown in FIG. 2, it is possible to prevent the outer shell from inadvertently becoming collapsed flat shape, whereby the retainability of the cup configuration are enhanced, when expanded, of the outer shell and also the self-holding ability of this cup configuration are enhanced, and thus the expanded cup can stand stable on a supporting surface such as a table.

Furthermore, in the cup of the present invention, there are provided, in the upper portion of the developed sheet of the outer shell between two pairs of cuts 41 and 41, a pair of substantially symmetrical C-shaped outer cuts 44 and 44 and another pair of substantially symmetrical C-shaped inner cuts 45 and 45. There may be provided two pairs of vertically extending folding lines 46, 46 and 46, 46 for connecting the end edges of the respective pairs of outer and inner C-shaped cuts. Those portions of the sheet which are left between the respective pairs of outer cuts 44 and inner cuts 45 and which are defined by the vertical folding lines 46 of the respective pairs constitute a pair of grip handles when folded to extend beyond the surface of the expanded outer shell.

Figure 8:
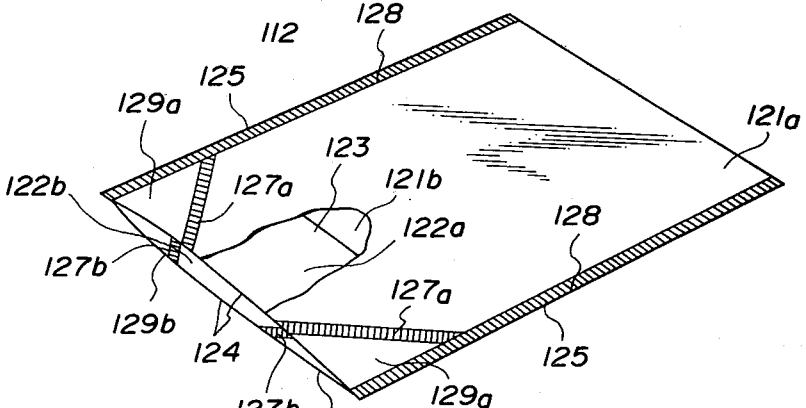
FIG. 8 is a diagrammatic perspective view, partly broken away, of another pouch structure of the foldable cup of the present invention.

FIG. 8 shows another pouch structure. This pouch is prepared by the use of a soft rectangular sheet such as aluminum foil having its one surface laminated with a synthetic resin film as in case of the preceding embodiment, and by folding this sheet in two, with that side having the laminated synthetic resin film lying inside. Thus, a pair of opposing body walls 121*a* and 121*b* and a pair of continuous bottom walls 122*a* and 122*b* located on the inner side of said opposing body walls are provided. The lateral side edge portions of both the body walls and the bottom walls are connected together by seal portions 128 and 128 which extend up to the bottom end edges. The body walls and the bottom walls are connected together by seal portions 127*a* and 127*b* which extend obliquely from the lateral edges toward the bottom end edges, similar to the pouch of the preceding embodiment.

Such pouch can be fixedly received inside the outer shell as in the case of the pouch of the preceding embodiment. When the outer shell is opened along the respective folding lines, the pouch is also opened together with the outer shell, without developing wrinkles or laggings in the bottom walls of the pouch. Those portions 129*a* and 129*b* of the pouch at which the body walls are superposed on the bottom walls are expanded together with the outer shell, so that the outer shell can be prevented from being collapsed or folded. Thus, the cup of this embodiment is able to retain its erect posture of the outer shell, when expanded, without the need of self-holding the expanded configuration of the outer shell by the cuts 41 and 41 provided in the preceding embodiment.

Figure 9:
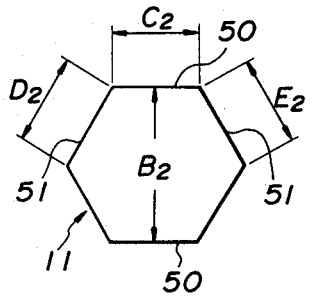
FIG. 9 is an explanatory illustration showing a cross section of the outer shell.
Figure 10:
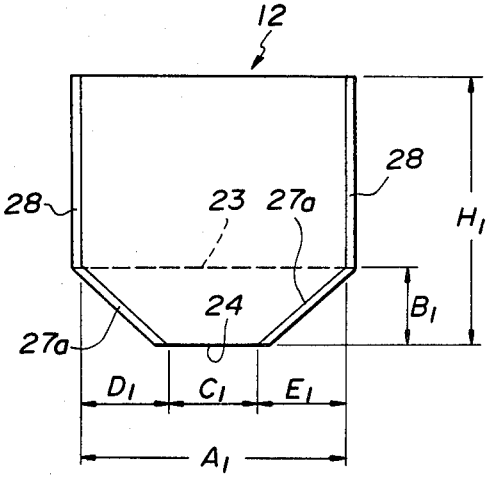
FIG. 10 is an explanatory illustration showing the front side of the pouch.

In order to insure that no crumples develop in the bottom wall of the pouch when the outer shell is expanded, it is desirable that the mutual dimensional relationship between the pouch and the outer shell be arranged as follows. FIGS. 9 and 10 describe such relations. FIG. 9 illustrates a cross section of the outer shell when expanded. FIG. 10 shows the front view of the pouch. The distance $A_1$ between the inner vertical side edge lines of the respective two seal portions 28 and 28 of the pouch, at which lines the seal portions 28 and 28 are bent inwardly when the pouch is inserted in the outer shell is set to be $\frac{1}{2}$ of the distance $A_2$ which is obtained by deducting the width of the marginal surplus end portion 16 from the distance between the lateral side edges of the developed sheet of outer shell as shown in FIG. 3. On the other hand, the distance $B_1$ from each bottom edge line 24 which connects each of the two down-going flaps or the bottom walls of the pouch with the bottom walls of the body walls up to the common each connecting line 23 of each upper edges of the bottom walls of the pouch is set to be $\frac{1}{2}$ of the distance $B_2$ between the opposing two walls 50 and 50 (FIG. 9) which are each defined by two inner folding lines 15 and 15 located within the lateral edges 14 and 14 of the expanded cup-shaped outer shell. The distance $C_1$ between the inner edges of the respective lower ends of the seal portions 27*a* and 27*a* at which these lower ends of the seal portions join the connecting line 24, i.e. the length of the connecting line 24, is set to be equal with the width $C_2$ of each of the opposing walls 50 and 50. The distance $D_1$ between the point at which the inner edge line of one 27*a* of the seal portions 27*a* and 27*a* joins the lateral seal portion 28 and the point at which said inner edge line of said seal portion 27*a* joins the connecting line 24 is set to be equal to the width $D_2$ of one of the walls 51 and 51 which are located adjacent to one of said opposing walls 50 and 50. Also, the distance $E_1$ between the point at which the inner edge line of the other 27*a* of the seal portions joins the lateral seal portion 28 and the point at which said inner edge line of said other seal portion 27*a* joins the connecting line 24 is set equal to the width $E_2$ of the other of the walls 51 and 51 which are adjacent, on the other side, to said one of the opposing walls 50 and 50. The distance $H_1$ between the connecting line 24 and the upper edge of the pouch or the body walls thereof is set equal to the distance $H_2$ between the upper and lower end edges of the outer shell, i.e. the height of the outer shell. In such arrangement, the outer shell, when expanded, will have a regular hexagonal cross section. Accordingly, the distances $C_1$, $D_1$ And $E_1$ will be uniform relative to each other.

Such dimensional relations as described above are based on the preassumption that the pouch is placed between the respective lateral edges, i.e. lateral vertical folding lines 14 and 14 of the outer shell, and that the pouch is fixed to the outer shell in this state. This fixation of these two members is performed by preliminarily providing adhesive strips of bonding agent on a required sites of the developed sheet of the outer shell, and by placing the pouch on this developed outer shell, and then by folding the outer shell and causing adhesion therebetween. The adhesive strips, as shown in FIG. 3, consist of an adhesive strip 55 formed on the outer shell along the upper edge thereof, another adhesive strip 56 located at a site of the outer shell corresponding to a pair of opposing walls 50 to extend along the bottom edge of the outer shell, still another adhesive strip 57 crossing the lateral vertical edges 14 and 14 at right angle and positioned at a distance from the bottom edge which is ½, preferably longer than that, of the distance between the abovesaid opposing walls 50 and 50 and having a length which is ½ of the length of each of said opposing walls and extending on both adjacent sides of said lateral vertical edges 14 and 14, and a further adhesive strip 58 located at one lateral edge and connecting the adhesive strips 55 and 56 together to bond the vertical edge portions of the outer shell together.

Figure 11:
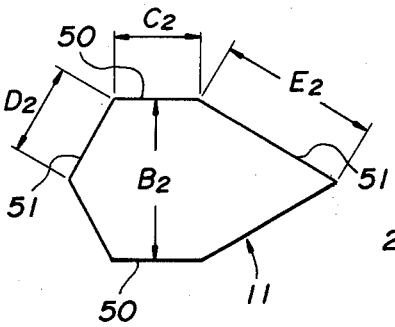
FIG. 11 is an explanatory illustration showing a cross section of the outer shell.
Figure 12:
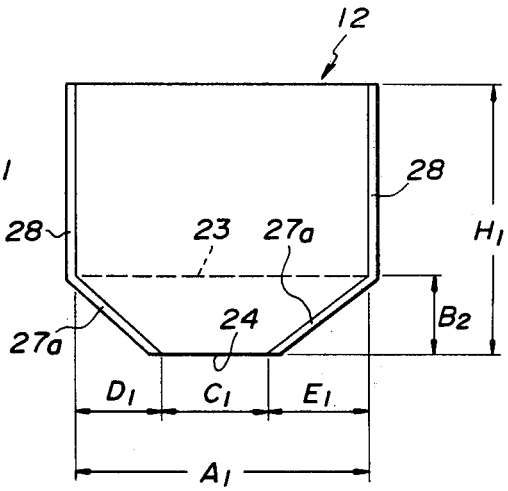
FIG. 12 is an explanatory illustration showing the front side of the pouch.

Such mutual relations between the pouch and the outer shell as stated above are not limited to the embodiment which provides a regular hexagonal cross section of the outer shell when expanded. It will be apparent without requiring detailed description that, for example, as shown in FIGS. 11 and 12, said mutual relations can be applied also to such irregular hexagonal cross section that, when the outer shell is expanded, the opposing portions 50 and 50 of the sheet are positioned parallel with each other and that the diagonal line connecting the lateral edges 14 and 14 passes at right angle through the center of a line connecting the opposing walls 50 and 50 together at right angle.

What is claimed is:

1. A foldable cup comprising:

a substantially tubular outer shell made of a stiff material and having longitudinally spaced opposite ends and two overlapping lateral edges extending between said ends, said shell being foldable along longitudinal fold lines parallel to said lateral edges to collapse said shell to a substantially flat condition, said cup including a pouch made of a flexible material disposed within said outer shell for accommodating contents, said pouch comprising a pair of opposing body walls bonded to the inside of said outer shell and having bottom wall portions foldable to lie between said body walls when said pouch is collapsed to a flat condition, said bottom wall portions having bottom edges flexibly connected to bottom edges of said body walls, respectively, and each bottom wall portion having a common edge flexibly joining said bottom wall portions together, said body walls and said bottom wall portions each being connected along lines extending obliquely from upper portion thereof with respect to said longitudinal fold lines toward the bottom edges of said respective body walls, said pouch including longitudinal lateral edges along which said body walls are flexibly connected, said lateral edges of said pouch extending from the upper edges of said body walls to a point intersecting the obliquely extending lines, the distance between said lateral edges of said pouch being substantially equal to the distance between said lateral edges of said outer shell, the distance between the upper and bottom edges of said pouch when folded being substantially equal to the distance between the upper and bottom edges of said outer shell, the distance between said common and bottom edges of said bottom wall portions of said pouch and the length of said obliquely extending lines being such that when said outer shell and pouch are unfolded, said bottom wall portions lie within the bottom edge of said outer shell, said lateral edges of said body walls of said pouch having opposing inner surfaces which are bonded together and folded exteriorly over onto one of said body walls of said pouch, the resulting folded portion of said lateral edges of said pouch being bonded to the adjacent body wall in the vicinity of said upper edge of said body wall of said pouch.

2. A foldable cup according to claim 1, in which said outer shell and said body walls of the pouch include extending portions formed at their upper edges, respectively, and the extending portions of the pouch are bonded together on the interiors thereof, respectively, and the extending portions of the outer shell have tear-off lines between these extending portions and said outer shell.

3. A foldable cup according to claim 2, in which the pouch has a cut formed at least on one of its lateral edges to correspond to said cut of the outer shell.

4. A foldable cup according to claim 1, in which the upper edges and the bottom edges of the body walls of the pouch and the portions of the pouch located near the intersection of the obliquely extending lines and the lateral edges of the pouch are bonded to the outer shell.

5. A foldable cup according to claim 4, in which the outer shell is provided with two parallel cut lines crossing the lateral edges at right angle and also with folding lines connecting the ends of these parallel cut lines, and one of said two cut lines is disposed on the outer shell at sites lower than the intersection of the obliquely extending lines of the pouch.

6. A foldable cup according to claim 5, in which the outer shell is provided with a pair of generally C-shaped cuts, another pair of generally C-shaped cuts and two pairs of folding lines connecting the end edges of said pairs of C-shaped cuts, respectively, whereby a pair of grip handles are formed by folding, outwardly along the said folding lines, portions of the outer shell left between the respective pairs of cuts.

7. A foldable cup according to claim 2 or 6, in which the contents enclosed in the pouch are instantly cookable foods having a powdery, granular or paste-like configuration and being intended to be mixed or dissolved or both in a liquid.

* * * * *